US008684852B1

(12) United States Patent
Henry et al.

(10) Patent No.: US 8,684,852 B1
(45) Date of Patent: Apr. 1, 2014

(54) ANGLED ROTATING MERRY GO ROUND

(75) Inventors: Brian K. Henry, Fort Payne, AL (US); Kim Blackwood, Boaz, AL (US)

(73) Assignee: Playcore Wisconsin, Inc., Chattanooga, TN (US)

( * ) Notice: Subject to any disclaimer, the term of this patent is extended or adjusted under 35 U.S.C. 154(b) by 97 days.

(21) Appl. No.: 13/353,913

(22) Filed: Jan. 19, 2012

(51) Int. Cl.
*A63G 1/12* (2006.01)

(52) U.S. Cl.
USPC ..... 472/14; 472/32

(58) Field of Classification Search
USPC ..... 472/14
See application file for complete search history.

(56) References Cited

U.S. PATENT DOCUMENTS 3,268,223 A * 8/1966 Woodsum, Jr. ..... 472/14
3,462,140 A * 8/1969 Halaj ..... 472/18
4,620,700 A * 11/1986 Snarr ..... 472/14
4,877,236 A * 10/1989 Shannon ..... 472/14

* cited by examiner

*Primary Examiner* — Michael Dennis
(74) *Attorney, Agent, or Firm* — McAndrews, Held & Malloy, Ltd.

(57) ABSTRACT

An angled rotating play device is provided as a cantileveredly merry-go-round supported above the ground from below. A foot platform provides a location for one or more riders feet along a first rotation axis and is angled at an acute angle relative to a vertical axis. The vertical axis may also provide a second rotation axis. At least one of a plurality of supports connect to at least one hand hold above the foot platform whereby the hand hold and/or covers over the hand hold provide a maximum elevation of the device and may help users to shift their weight to self drive the device from the device.

16 Claims, 2 Drawing Sheets

ANGLED ROTATING MERRY GO ROUND

FIELD OF THE INVENTION

An angled rotating merry go round provides a merry-go-round for a limited number of users provides a rotating base or foot platform angled relative to a ground surface and from the foot platform extends a hand hold, such as a ring extends upwardly thereabove and connects thereto for use by users for holding on and/or to assist in extending their bodies towards and away from a rotation axis to thereby assist in providing self sustaining rotation in cooperation with gravity for play.

BACKGROUND OF THE INVENTION

The applicant discovered that angled rotating devices can provide an enhanced experience play. A Tilted Skyrunner™ has been sold for a number of years. Children or adults can grab an overhead ring which rotates about an angled hub. Depending on how the individual elects to swing their body relative to the inside or the outside of the ring based on the position of the ring relative to its rotation, one or more users can make the rotation self-sustaining.

In a similar context, the GT Xccelerator™ has been sold for a number of years by the applicant. This device has an angled rotating bar below a hand hold supported from both above and below which rotates in the axis of rotation and allows children to shift their body weight to make the toy spin by themselves. Both of these play devices provided by the applicant provide excellent play. However, both of these prior art devices require support from above the users which necessarily adds to the cost of providing those products to the marketplace.

Accordingly, an alternative design for an angled rotating play device is desired which can maximize the fun experience for the user while preferably making a more cost effective design for the provider, at least in some embodiments.

SUMMARY OF THE INVENTION

It is an object of the present invention to provide an improved merry-go-round play device.

It is another object of the present invention to provide an improved tilted rotating play device.

The present invention relates to a cantileveredly supported angled rotating device which provides a foot platform as well as a hand hold device supported above the platform onto which one or more riders can enjoy the play experience. Specifically, by shifting the body weight of the rider or riders, one or more riders can spin the play device about its rotation axis.

In a preferred embodiment, the hand hold device is provided in the form of a ring which is supported by supports preferably extending from near a perimeter of the foot platform to the ring so that the ring extends concentrically about a rotation axis but preferably does not intersect the rotation axis. Furthermore, the ring may be configured for many embodiments for children such as ages five to twelve to be able to utilize the ring as a handhold to assist in shifting their weight such as by pushing and pulling actions to self-sustain or drive, possibly without the assistance of others on the foot platform in an effort to make the platform rotate in a sustaining manner.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
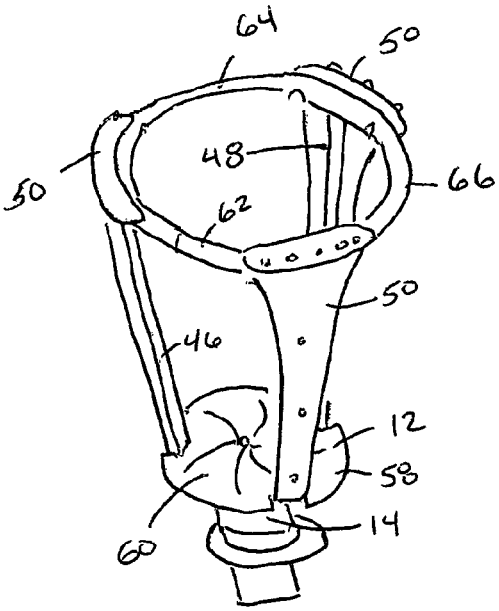
FIG. 1 is a top perspective view of a presently preferred embodiment of the present invention.

FIG. 1 shows a angled spinning device 10 of a presently preferred embodiment of the present invention. The device 10 has a foot platform 12 onto which the user may preferably put their feet. The foot platform 12 is supported from below by a first hub 14 which cantileveredly supports the foot platform 12 relative to a play surface 15.

The first hub 14 preferably connects to a head 16 which may connect at a shoulder 18 to the body 20. The body 20 may be fixed or rotatable relative to a post 22 illustrated aligned along vertical axis 24. The head 16 provides at least a portion 17 angled at acute angle $\alpha$ relative to the vertical or first axis 24 which is an acute angle between about 1 and 30 degrees and preferably between about 1 and 10 degrees such as about 5 degrees. The first hub 14 is also preferably aligned at the acute angle $\alpha$ which also allows the first hub 14 to provide a second or rotation axis 26 at angle $\alpha$ relative to the vertical axis 24. Rotational axis 26 may be centrally disposed relative to foot platform 12 and/or other portions of the device 10 as will be discussed below.

Post 22 is shown extending downwardly to possibly be rested upon a brick or other equivalent structure 28. Concrete 30 can then extend about anchor 32 and/or post 22 such as illustrated or otherwise. Earth 34 may be utilized to cover at least a portion of the concrete 30. A finished or play surface 36 such as mulch or other suitable playground structure can preferably be provided over the earth 34 for at least some installations. The first hub 14 is shown having an internal bearing assembly 38 which can connect to the head 16 as would be understood by those of ordinary skill in the art. Other hub constructions can be utilized with other embodiments including those constructions described below.

Figure 2:
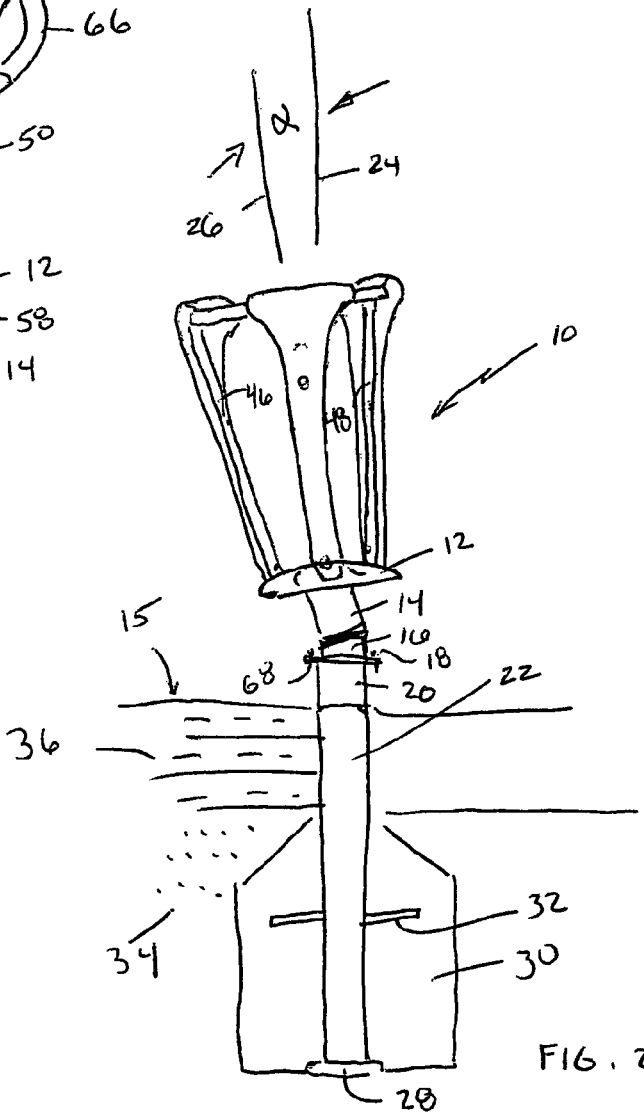
FIG. 2 is a side plan view of the embodiment of FIG. 1 including a portion extending below a ground surface.
Figure 3:
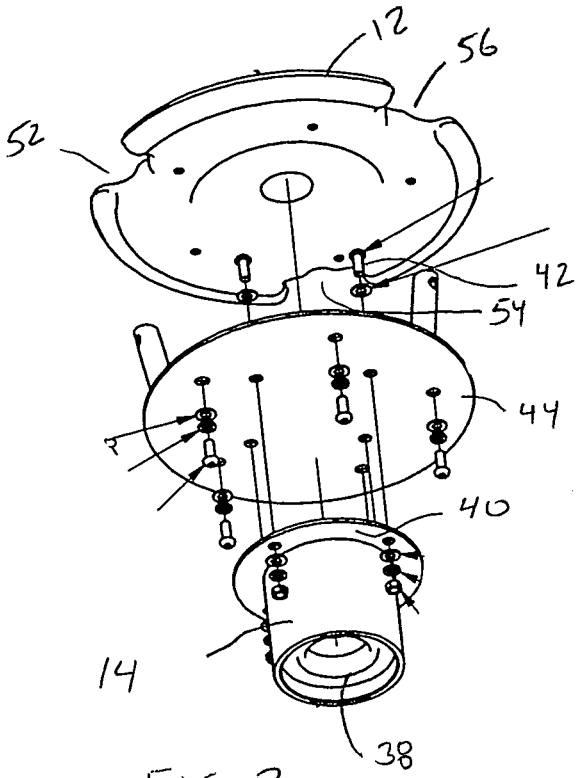
FIG. 3 is an exploded view of a first portion of a rotation assembly shown in FIGS. 1 and 2.
Figure 4:
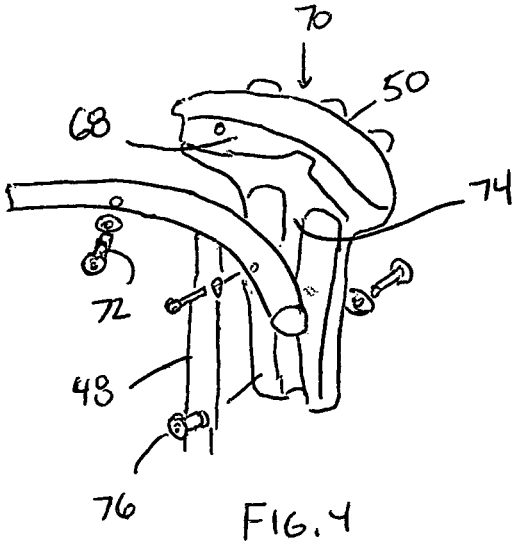
FIG. 4 is an exploded view of a portion of the hand hold shown in FIG. 1.

As shown in FIG. 3, an upper portion of the first hub 14 may have a flange 40 which may receive connectors such as bolts 42 which can extend through the bores or slots through the flange 40 and through the basket weld assembly 44 possibly to connect the first hub 14 through the basket weld assembly 44 to the foot platform 12 for at least some embodiments. Connections 42 are shown passing into and/or through the basket weld assembly 44 as well. As would be understood by reference to FIGS. 1 and 2, there are at least one support 46 and 48 with the third being obscured from view by one of the covers 50. These three supports 46,48 are shown spaced equidistantly relative to one another about the foot platform 12. Other embodiments could have other constructions. Furthermore, the supports 46,48 are shown with reference to FIG. 3 as being welded to the basket weld assembly 44 at a bottom portion thereof and the pass-through cutouts 52,54,56 of the foot platform 12. Other connections could be provided with other embodiments.

An outermost extremity of a perimeter 58 of the foot platform 12 may extend radially relative to the rotational axis 26 radially outwardly of the supports 46,48 where supports 46,48 pass by the foot platform 12. Covers 50 may also have a shorter radial distance relative to the rotational axis as they pass through the foot platform 12 through the cutouts 50,54, 56 as well than the outermost extremity of the perimeter 58 as well. The covers 50 are shown downwardly extending past an upper surface 60 of the foot platform 12 in the preferred embodiment. Other embodiments may have alternate constructions. The covers 50 also extend elevationally above a portion of a hand hold 62. Hand hold 62 is shown illustrated as a ring centered about rotation axis 26. Only one hand hold 62 is shown as would be understood by those of ordinary skill in the art, but multiple hand holds could be provided such as by hand hold segments 64,66 spaced by cover 50 as illustrated in FIG. 1 or whether portions of one or more different rings or other structures. By having multiple hand holds 64,66 and others, multiple riders can ride the device 10 at the same time and/or a rider can ride in different positions.

FIG. 2 shows the flange 18 connected at circumferential portions of the flange 18 to the body 20 such as with connectors 68 as would be known by those of ordinary skill in the art. This allows for the relatively easy to repair, if necessary, of the device 10 and/or replacement while maintaining the post 22 in position.

The head 16 is preferably angled relative to the body 20 along the rotational axis 26. The rotational axis is angled relative to the vertical axis 24 at the acute angle $\alpha$.

As explained above, first hub 14 is preferably connected to the basket weld assembly 44 and at least one support 46,48 is welded or otherwise connected to the basket weld assembly 44. A foot platform 12 then may connect to the top of the foot basket weld assembly 44 as shown for many embodiments.

The base or foot platform 12 preferably rotates with the hub 40 and the at least one support 46,48 which may be welded to the basket weld assembly 44 may also rotate with the rotation of the first hub 14.

The at least one hand hold 62 can be provided as a ring and/or other suitable structure or structures. The at least one support 48 is preferably at least partially covered with a cover 50 which may preferably provide a first channel 68 which receives a portion of the hand hold therein. Furthermore, the cover 50 also has a upper most portion 70 which extends elevationally above the hand hold portion such as portion 64. First connectors 72 are shown passing through the portion of the hand hold 64 and into the cover 50 through the first channel 68. Similarly, second channel 74 receives a portion of the at least one support such as at least one support 48. In fact, with the preferred embodiment, the second channel 74 on the cover extends from the hand hold portion 64 down to and even past the foot platform 12. Second connectors 76 are shown extending through the at least one support 48 and the second channel 74 thereby securing the cover 50 to the at least one support 48.

When the hand hold portion 64,66 provides a ring 62, the ring 62 may preferably provide a consistent radius about the rotation axis 26 such as is illustrated or otherwise. The ring 62 may be circular or other shape for other embodiments.

Furthermore, at least one of the ring 62 and the covers 50 may preferably provide an uppermost elevation of the device 10. This is believed different from the prior art designs which were at least partially, if not entirely, supported at an upper elevation above the hand holds.

Figure 5:
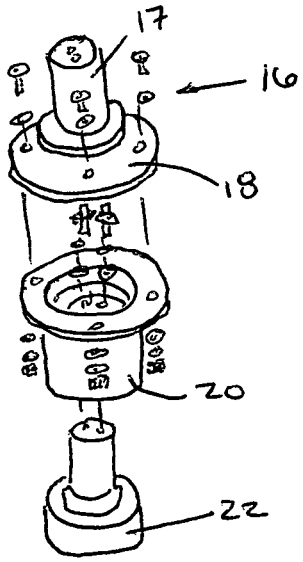
FIG. 5 is an exploded view of a second portion of a rotation assembly shown in FIGS. 1 and 2.

FIG. 5 shows the head 16 connected to a second hub illustrated as the body 20. In addition to the first axis 26, the second axis 24 for at least some embodiments provides a rotation axis allowing the head 16 to rotate relative to post 22 about second axis 24. Second hub or body 20 may also provide an internal bearing assembly whereby arm 23 is received internal to body 20 for at least some embodiments.

Self sustaining rotation can occur about the first axis 26 and possibly about the second axis 24 in a gyroscopic or other fashion for some embodiments or at least around the first axis 26. Some embodiments may allow for others such as those not on device 10 to continue or start rotation about second axis 24.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An angled rotating play device comprising:

a first hub cantileveredly supported from below, said first hub angled at an acute angle greater than one degree and less than thirty degrees relative to a second axis with the first hub connected to a basket weld assembly with connectors and the connectors extend through a flange at the uppermost portion of the first hub a first axis extending through the first hub at the acute angle;

a foot platform connected to the first hub rotatably disposed about the first axis, with the foot platform connected to the basket weld assembly and the connectors extend through the foot platform through the basket weld assembly to be connected to the flange of the first hub;

at least one support operably coupled to the hub and extending upwardly above the foot platform; and at least one hand hold connected to the at least one support.

2. The angled rotating play device of claim 1 wherein the at least one support further comprises at least three supports equidistantly spaced from one another at the foot platform.

3. The angled rotating play device of claim 1 wherein the hub has an internal bearing assembly connected to a head, and the head is operably coupled to a post extending from a ground.

4. The angled rotating play device of claim 3 wherein the head supported on a shoulder connected to a second hub wherein the second hub is operably coupled to the post.

5. The angled rotating play device of claim 4 wherein the head is angled at the acute angle relative to the body.

6. The angled rotating play device of claim 5 wherein the second hub is rotatably disposed relative to the post extending along the first axis into the ground.

7. The angled rotating play device of claim 4 wherein the first hub is connected to a basket weld assembly and the basket weld assembly is welded to the at least one support and the foot platform is connected on top of the basket weld assembly.

8. The angled rotating play device of claim 7 further comprising cutouts through the foot platform through which at least one support passes through.

9. The angled rotating play device of claim 8 wherein the perimeter of platform provides a radius extending radially outwardly relative to the at least one support of the location wherein the at least one support passes by the foot platform.

10. The angled rotating play device of claim 1 wherein the foot platform and the at least one support rotate together.

11. An angled rotating play device comprising:

a first hub cantileveredly supported from below, said first hub angled at an acute angle greater than one degree and less than thirty degrees relative to a second axis;

a first axis extending through the first hub at the acute angle;

a foot platform connected to the first hub rotatably disposed about the first axis, at least one support operably coupled to the hub and extending upwardly above the foot platform; and at least one hand hold provided as a portion of a ring connected to the at least one support, and the at least one support has a cover and the cover has a first channel which receives a portion of the ring therethrough with the first channel extending over and above the ring.

12. The angled rotating play device of claim 11 further comprising a second channel downwardly extending radially outwardly of the at least one support and receiving at least one support therein.

13. The angled rotating play device of claim 12 wherein the cover extends elevationally at least below the foot platform.

14. The angled rotating play device of claim 13 wherein connectors extend through at least one of the ring and the at least one support through one of the first and second channels to connect the cover to the device.

15. The angled rotating play device of claim 11 wherein the ring is circular and provides a constant radius relative to the rotation axis.

16. The angled rotating play device of claim 11 further comprising at least one cover and wherein one of the rings and the at least one cover provides a highest elevation of the device.

* * * * *